US011618977B2

(12) United States Patent
Barnholtz et al.

(10) Patent No.: US 11,618,977 B2
(45) Date of Patent: Apr. 4, 2023

(54) FIBROUS ELEMENTS AND FIBROUS STRUCTURES EMPLOYING SAME

(71) Applicant: The Procter & Gamble Company, Cincinnati, OH (US)

(72) Inventors: Steven Lee Barnholtz, West Chester, OH (US); Michael Donald Suer, Cincinnati, OH (US); Paul Dennis Trokhan, Hamilton, OH (US); Alan Howard Ullman, Blue Ash, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 301 days.

(21) Appl. No.: 17/118,679

(22) Filed: Dec. 11, 2020

(65) Prior Publication Data

US 2021/0095395 A1 Apr. 1, 2021

Related U.S. Application Data

(62) Division of application No. 12/917,585, filed on Nov. 2, 2010, now Pat. No. 10,895,022.

(60) Provisional application No. 61/257,275, filed on Nov. 2, 2009.

(51) Int. Cl.

| | |
|---|---|
| ***D01F 1/10*** | (2006.01) |
| ***D21H 13/00*** | (2006.01) |
| ***D21H 27/00*** | (2006.01) |
| ***D04H 1/56*** | (2006.01) |
| ***D04H 1/4291*** | (2012.01) |
| ***D04H 1/407*** | (2012.01) |

(52) U.S. Cl.

CPC ..... *D01F 1/10* (2013.01); *D04H 1/407* (2013.01); *D04H 1/4291* (2013.01); *D04H 1/56* (2013.01); *D21H 13/00* (2013.01); *D21H 27/002* (2013.01); *Y10T 428/1397* (2015.01); *Y10T 428/298* (2015.01)

(58) Field of Classification Search

CPC ..... D01F 1/10; D04H 1/407; D04H 1/4291; D04H 1/56; D21H 13/00; D21H 27/002; Y10T 428/1397; Y10T 428/298

See application file for complete search history.

(56) References Cited

U.S. PATENT DOCUMENTS

| | | | |
|---|---|---|---|
| 2,008,031 | A | 7/1935 | Arthur |
| 2,175,045 | A | 10/1939 | Rudolf |
| 3,521,638 | A | 7/1970 | Parrish |
| 3,838,692 | A | 10/1974 | Levesque |
| 3,954,361 | A | 5/1976 | Page |

(Continued)

FOREIGN PATENT DOCUMENTS

| | | | |
|---|---|---|---|
| DE | 19959832 | A1 | 7/2001 |
| EP | 0080382 | A1 | 6/1983 |

(Continued)

OTHER PUBLICATIONS

All Office Actions; U.S. Appl. No. 12/917,558.

(Continued)

*Primary Examiner* — James C Yager

(74) *Attorney, Agent, or Firm* — C. Brant Cook

(57) ABSTRACT

Fibrous elements, such as filaments, and more particularly to fibrous elements employing a polymer and a wetting agent, methods for making such fibrous elements, fibrous structures employing such fibrous elements, methods for making such fibrous structures and packages containing such fibrous structures are provided.

20 Claims, 8 Drawing Sheets

(56) References Cited

U.S. PATENT DOCUMENTS 4,100,324 A 7/1978 Anderson et al.
4,118,531 A 10/1978 Hauser
4,139,699 A 2/1979 Hernandez et al.
4,203,939 A 5/1980 Drachenberg et al.
4,243,480 A 1/1981 Hernandez et al.
4,355,066 A 10/1982 Newman
4,370,289 A 1/1983 Sorenson
4,436,780 A 3/1984 Hotchkiss et al.
4,604,313 A 8/1986 Mcfarland et al.
4,623,576 A 11/1986 Lloyd et al.
4,634,621 A 1/1987 Manning et al.
4,636,418 A 1/1987 Kennard et al.
4,675,226 A 6/1987 Ott
4,720,415 A 1/1988 Vander
4,724,114 A 2/1988 Mcfarland et al.
4,786,550 A 11/1988 Mcfarland et al.
4,803,117 A 2/1989 Daponte
4,851,168 A 7/1989 Graiver et al.
4,855,179 A 8/1989 Bourland et al.
4,863,779 A 9/1989 Daponte
4,879,170 A 11/1989 Radwanski et al.
4,885,202 A 12/1989 Lloyd et al.
4,906,513 A 3/1990 Kebbell et al.
4,931,355 A 6/1990 Radwanski et al.
4,939,016 A 7/1990 Radwanski et al.
4,970,104 A 11/1990 Radwanski
5,087,506 A 2/1992 Palumbo
5,094,717 A 3/1992 Manning et al.
5,120,888 A 6/1992 Nohr
5,145,727 A 9/1992 Potts et al.
5,149,576 A 9/1992 Potts et al.
5,204,165 A 4/1993 Schortmann
5,227,107 A 7/1993 Dickenson et al.
5,254,133 A 10/1993 Seid
5,254,399 A 10/1993 Oku et al.
5,272,236 A 12/1993 Lai et al.
5,284,703 A 2/1994 Everhart et al.
5,350,624 A 9/1994 Georger et al.
5,375,306 A 12/1994 Roussin-moynier
5,409,768 A 4/1995 Dickenson et al.
5,427,696 A 6/1995 Phan et al.
5,436,066 A 7/1995 Chen
5,476,616 A 12/1995 Schwarz
5,508,102 A 4/1996 Georger et al.
5,509,915 A 4/1996 Hanson
5,536,563 A 7/1996 Shah et al.
5,539,056 A 7/1996 Yang et al.
5,587,225 A 12/1996 Griesbach et al.
5,597,873 A 1/1997 Chambers et al.
5,611,890 A 3/1997 Vinson et al.
5,629,080 A 5/1997 Gupta et al.
5,652,048 A 7/1997 Haynes et al.
5,811,178 A 9/1998 Adam et al.
5,814,570 A 9/1998 Cohen
5,853,867 A 12/1998 Harada et al.
5,948,710 A 9/1999 Pomplun et al.
5,952,251 A 9/1999 Jackson et al.
6,103,061 A 8/2000 Anderson et al.
6,150,005 A 11/2000 Williams et al.
6,172,276 B1 1/2001 Hetzler et al.
6,177,370 B1 1/2001 Skoog et al.
6,179,325 B1 1/2001 Igawa
6,200,120 B1 3/2001 Fish et al.
6,296,936 B1 10/2001 Yahiaoui et al.
6,319,342 B1 11/2001 Riddell
6,348,133 B1 2/2002 Woodrum
6,348,253 B1 2/2002 Daley et al.
6,361,784 B1 3/2002 Brennan
6,383,336 B1 5/2002 Shannon
6,417,120 B1 7/2002 Mitchler et al.
6,423,884 B1 7/2002 Oehmen
6,465,073 B1 10/2002 Morman
6,488,801 B1 12/2002 Bodaghi et al.
6,494,974 B2 12/2002 Riddell
6,503,370 B2 1/2003 Hollmark et al.
6,506,873 B1 1/2003 Ryan et al.
6,550,115 B1 4/2003 Skoog et al.
6,589,892 B1 7/2003 Smith et al.
6,608,236 B1 8/2003 Burnes et al.
6,621,679 B1 9/2003 Segervall
6,686,303 B1 2/2004 Haynes et al.
6,709,526 B1 3/2004 Bailey et al.
6,723,795 B1 4/2004 Dupire et al.
6,739,023 B2 5/2004 Vonfeldt et al.
6,759,356 B1 7/2004 Myers
6,797,226 B2 9/2004 Annable
6,811,638 B2 11/2004 Close et al.
6,823,568 B1 11/2004 Kobayashi et al.
6,836,937 B1 1/2005 Boscolo
6,946,413 B2 9/2005 Lange et al.
6,979,386 B1 12/2005 Wallajapet et al.
6,986,932 B2 1/2006 Zink et al.
6,992,028 B2 1/2006 Thomaschefsky et al.
7,000,000 B1 2/2006 Obrien
7,028,429 B1 4/2006 Druliner
7,029,620 B2 4/2006 Gordon et al.
7,041,369 B1 5/2006 Mackey et al.
7,176,150 B2 2/2007 Kopacz et al.
7,410,683 B2 8/2008 Curro et al.
7,425,517 B2 9/2008 Deka et al.
7,696,109 B2 4/2010 Ouellette et al.
7,879,172 B2 2/2011 Kopacz et al.
7,902,096 B2 3/2011 Brandner et al.
7,994,079 B2 8/2011 Chen et al.
7,994,081 B2 8/2011 Farell et al.
7,998,889 B2 8/2011 Stralin et al.
8,017,534 B2 9/2011 Harvey et al.
10,895,022 B2 1/2021 Barnholtz et al.
2003/0024662 A1 2/2003 Besemer et al.
2003/0073367 A1 4/2003 Kopacz et al.
2003/0131457 A1 7/2003 Krautkramer et al.
2003/0135172 A1 7/2003 Whitmore et al.
2003/0144641 A1 7/2003 Chen et al.
2003/0150090 A1 8/2003 Krautkramer et al.
2003/0200991 A1 10/2003 Keck
2003/0220039 A1 11/2003 Chen et al.
2004/0048542 A1 3/2004 Thomaschefsky et al.
2004/0065422 A1 4/2004 Hu et al.
2004/0087237 A1 5/2004 Garnier et al.
2004/0096656 A1 5/2004 Bond
2004/0106723 A1 6/2004 Yang et al.
2004/0163781 A1 8/2004 Hernandez-munoa et al.
2004/0181199 A1 9/2004 Moberg-alehammar et al.
2005/0020170 A1 1/2005 Deka et al.
2005/0056956 A1 3/2005 Zhao et al.
2005/0090175 A1 4/2005 Bergholm et al.
2005/0103455 A1 5/2005 Edwards et al.
2005/0112980 A1 5/2005 Strandqvist et al.
2005/0130536 A1 6/2005 Siebers et al.
2005/0130544 A1 6/2005 Cheng et al.
2005/0133177 A1 6/2005 Stralin et al.
2005/0136765 A1 6/2005 Shannon
2005/0136772 A1 6/2005 Chen et al.
2005/0136778 A1 6/2005 Thomaschefsky et al.
2005/0137540 A1 6/2005 Villanueva et al.
2005/0148261 A1 7/2005 Close et al.
2005/0148264 A1 7/2005 Varona et al.
2005/0159065 A1 7/2005 Stralin et al.
2005/0170727 A1 8/2005 Melik et al.
2005/0177122 A1 8/2005 Berba et al.
2005/0245159 A1 11/2005 Chmielewski et al.
2005/0247416 A1 11/2005 Forry et al.
2005/0274470 A1 12/2005 Shannon et al.
2006/0084340 A1 4/2006 Bond et al.
2006/0086633 A1 4/2006 Kleinsmith
2006/0088697 A1 4/2006 Manifold et al.
2007/0010153 A1 1/2007 Shaffer et al.
2007/0039704 A1 2/2007 Cabell et al.
2007/0049153 A1 3/2007 Dunbar et al.
2007/0063091 A1 3/2007 Neveu
2007/0077841 A1 4/2007 Zoch et al.
2007/0142803 A1 6/2007 Soerens et al.
2007/0173162 A1 7/2007 Ethiopia et al.
2007/0202766 A1 8/2007 Ouellette et al.

(56) References Cited

U.S. PATENT DOCUMENTS

| | | | |
|---|---|---|---|
| 2007/0232180 | A1 | 10/2007 | Polat et al. |
| 2007/0272381 | A1 | 11/2007 | Elony et al. |
| 2008/0000602 | A1 | 1/2008 | Dyer et al. |
| 2008/0008853 | A1 | 1/2008 | Hupp et al. |
| 2008/0041543 | A1 | 2/2008 | Dyer |
| 2008/0050996 | A1 | 2/2008 | Stralin et al. |
| 2008/0051471 | A1 | 2/2008 | Kronberg et al. |
| 2008/0142178 | A1 | 6/2008 | Haubrich et al. |
| 2008/0241538 | A1 | 10/2008 | Lee et al. |
| 2008/0248239 | A1 | 10/2008 | Pomeroy et al. |
| 2009/0022960 | A1 | 1/2009 | Suer et al. |
| 2009/0022983 | A1 | 1/2009 | Cabell et al. |
| 2009/0023839 | A1 | 1/2009 | Barnholtz et al. |
| 2009/0025894 | A1 | 1/2009 | Barnholtz et al. |
| 2009/0084513 | A1 | 4/2009 | Barnholtz et al. |
| 2009/0151748 | A1 | 6/2009 | Ridenhour |
| 2009/0220741 | A1 | 9/2009 | Manifold |
| 2009/0220769 | A1 | 9/2009 | Manifold |
| 2010/0239825 | A1 | 9/2010 | Sheehan et al. |
| 2010/0326612 | A1 | 12/2010 | Hupp et al. |
| 2011/0104493 | A1 | 5/2011 | Barnholtz et al. |
| 2011/0104970 | A1 | 5/2011 | Barnholtz et al. |
| 2011/0209840 | A1 | 9/2011 | Barnholtz et al. |
| 2011/0220310 | A1 | 9/2011 | Polat et al. |
| 2011/0244199 | A1 | 10/2011 | Brennan et al. |

FOREIGN PATENT DOCUMENTS

| | | | |
|---|---|---|---|
| EP | 0156160 | A2 | 10/1985 |
| EP | 0156649 | A2 | 10/1985 |
| EP | 0294137 | A1 | 12/1988 |
| EP | 0308320 | A2 | 3/1989 |
| EP | 0341977 | A2 | 11/1989 |
| EP | 0423619 | A1 | 4/1991 |
| EP | 0357496 | B1 | 5/1994 |
| EP | 0333209 | B1 | 6/1994 |
| EP | 0205242 | B2 | 11/1995 |
| EP | 0865755 | A1 | 9/1998 |
| EP | 0590307 | B1 | 12/1998 |
| EP | 0992338 | A2 | 4/2000 |
| EP | 1132427 | A1 | 9/2001 |
| EP | 1300511 | A2 | 4/2003 |
| EP | 1589137 | A1 | 10/2005 |
| EP | 1887036 | A2 | 2/2008 |
| EP | 1504145 | B1 | 11/2008 |
| EP | 2028296 | A1 | 2/2009 |
| GB | 2113731 | A | 8/1983 |
| JP | 59211667 | A | 11/1984 |
| JP | 08174735 | A | 7/1996 |
| JP | 2000303335 | A2 | 10/2000 |
| JP | 2002088660 | A | 3/2002 |
| JP | 2004141255 | A | 5/2004 |
| JP | 2005218525 | A2 | 8/2005 |
| JP | 2007522284 | A | 8/2007 |
| WO | 9207985 | A1 | 5/1992 |
| WO | 9419179 | A1 | 9/1994 |
| WO | 9737757 | A1 | 10/1997 |
| WO | 9803713 | A1 | 1/1998 |
| WO | 9827257 | A2 | 6/1998 |
| WO | 9836117 | A1 | 8/1998 |
| WO | 9855295 | A1 | 12/1998 |
| WO | 0005065 | A1 | 2/2000 |
| WO | 0011998 | A1 | 3/2000 |
| WO | 0021476 | A1 | 4/2000 |
| WO | 0029655 | A1 | 5/2000 |
| WO | 0038565 | A1 | 7/2000 |
| WO | 0063486 | A1 | 10/2000 |
| WO | 0069963 | A1 | 11/2000 |
| WO | 0109023 | A1 | 2/2001 |
| WO | 0166345 | A1 | 9/2001 |
| WO | 0250357 | A1 | 6/2002 |
| WO | 02053003 | A2 | 7/2002 |
| WO | 02053365 | A2 | 7/2002 |
| WO | 03050347 | A1 | 6/2003 |
| WO | 03080905 | A1 | 10/2003 |
| WO | 2004092474 | A2 | 10/2004 |
| WO | 2005065516 | A2 | 7/2005 |
| WO | 2005065932 | A1 | 7/2005 |
| WO | 2005073446 | A1 | 8/2005 |
| WO | 2005080497 | A1 | 9/2005 |
| WO | 2005106085 | A1 | 11/2005 |
| WO | 2005118934 | A1 | 12/2005 |
| WO | 2006027810 | A1 | 3/2006 |
| WO | 2006060813 | A1 | 6/2006 |
| WO | 2006060815 | A2 | 6/2006 |
| WO | 2006060816 | A1 | 6/2006 |
| WO | 2006069120 | A2 | 6/2006 |
| WO | 2007070064 | A1 | 6/2007 |
| WO | 2007070075 | A1 | 6/2007 |
| WO | 2007078344 | A1 | 7/2007 |
| WO | 2007092303 | A2 | 8/2007 |
| WO | 2007098449 | A1 | 8/2007 |
| WO | 2007100936 | A2 | 9/2007 |
| WO | 2007124866 | A1 | 11/2007 |
| WO | 2007135624 | A2 | 11/2007 |
| WO | 2008005500 | A2 | 1/2008 |
| WO | 2008050311 | A2 | 5/2008 |
| WO | 2008073101 | A1 | 6/2008 |
| WO | 2009010938 | A1 | 1/2009 |
| WO | 2009010939 | A2 | 1/2009 |
| WO | 2009010940 | A2 | 1/2009 |
| WO | 2009010941 | A2 | 1/2009 |
| WO | 2009010942 | A2 | 1/2009 |
| WO | 2009105490 | A1 | 8/2009 |
| WO | 2011019908 | A1 | 2/2011 |
| WO | 2011053677 | A1 | 5/2011 |

OTHER PUBLICATIONS

All Office Actions; U.S. Appl. No. 12/917,574.

All Office Actions; U.S. Appl. No. 12/917,585.

Anonymous, "NanoDispense® Contact Angle Measurements", First Ten Angstroms,(Oct. 3, 2004). Retrieved from the Internet: URL:http://www. firsttenangstroms. com/pdf docs/N anoDispenseExamples. pdf, (retrieved Feb. 15, 2011) Entire document.

Complete Textile Glossary, Celaneses Acetate (2001), definition of "filament".

International Search Report and Written Opinion; Application Ser. No. PCT/US2010/055072; dated Feb. 23, 2011, 13 pages.

Meyer, et al., "Comparison between different presentations of pore size distribution in porous materials", Fresenius J. Anal Chem. 1999. 363: pp. 174-178.

FIBROUS ELEMENTS AND FIBROUS STRUCTURES EMPLOYING SAME

CROSS REFERENCE TO RELATED APPLICATION

This application is a divisional application of U.S. application Ser. No. 12,017,585, filed Nov. 2, 2010, which claims the benefit of U.S. Provisional Application No. 61/257,275, filed Nov. 2, 2009.

FIELD OF THE INVENTION

The present invention relates to fibrous elements, such as filaments, and more particularly to fibrous elements comprising a polymer and a wetting agent, methods for making such fibrous elements, fibrous structures employing such fibrous elements, methods for making such fibrous structures and packages comprising such fibrous structures.

BACKGROUND OF THE INVENTION

Fibrous elements (filaments and/or fibers) comprising wetting agents are known in the art. For example, polypropylene filaments comprising wetting agents are known in the art. Wetting agents have been used both as surface treating agents on hydrophobic fibrous elements, such as polypropylene filaments and/or polyester fibers, and as melt treating agents within polymer melt compositions that are spun into filaments, such as polypropylene filaments. However, these wetting agents and/or executions have been less than successful, especially for smaller diameter (diameters of less than 2 μm) filaments. As a result of the problem of hydrophilizing inherently hydrophobic less than 2 μm diameter filaments, fibrous structures incorporating such filaments have exhibited hydrophobic properties depending upon the amount of such filaments present within the fibrous structures.

Fibrous structures comprising fibrous elements comprising wetting agents are also known. However, due to the problems associated with conventional wetting agents and/or executions for applying wetting agents to hydrophobic fibrous elements, such as reducing the surface tension of absorbed fluids thereby altering the ability of the fibrous structure to hold onto the fluid, it is challenging for formulators to make the hydrophobic fibrous structures less hydrophobic and/or even hydrophilic.

Accordingly, there is a need for a fibrous element, such as a filament, comprising a polymer and a wetting agent that overcomes the negatives associated with prior hydrophobic filaments and fibrous structures comprising fibrous elements.

SUMMARY OF THE INVENTION

The present invention fulfills the needs described above by providing a novel filament comprising a polymer and a wetting agent, fibrous structures employing same, methods for making same and packages containing such fibrous structures.

In one example of the present invention, a fibrous element, such as a filament, comprising a polymer and a wetting agent, wherein the wetting agent is present at a level of greater than 0% but less than 2% by weight of the fibrous element and wherein the fibrous element exhibits a diameter of less than 2 μm as measured according to the Diameter Test Method described herein, and a contact angle of less than about 80° as measured according to the Contact Angle Test Method described herein, is provided.

In another example of the present invention, a fibrous structure comprising a fibrous element, such as a filament, of the present invention is provided.

In yet another example of the present invention, a method for making a fibrous element such as a filament, comprising the steps of:

a. mixing a fibrous element-forming polymer and a wetting agent to make a spinning composition; and b. spinning a fibrous element from the spinning composition such that the fibrous element exhibits a diameter of less than 2 μm as measured according to the Diameter Test Method described herein and a contact angle of less than about 80° as measured by the Contact Angle Test Method described herein, wherein the fibrous element comprises greater than 0% but less than 2% by weight of the fibrous element of the wetting agent, is provided.

In even another example of the present invention, a method for making a fibrous structure comprising the step of associating a plurality of fibrous elements, such as filaments, comprising a fibrous element-forming polymer and a wetting agent present at a level of greater than 0% but less than 2% by weight of the fibrous elements, wherein the fibrous elements exhibit a diameter of less than 2 μm as measured according to the Diameter Test Method described herein and a contact angle of less than about 80° as measured according to the Contact Angle Test Method described herein, such that a fibrous structure is formed, is provided.

In even yet another example of the present invention, a method for making a fibrous structure comprising the steps of;

a. spinning a plurality of fibrous elements, such as filaments, from a spinning composition comprising a fibrous element-forming polymer and a wetting agent present at a level of greater than 0% but less than 2% by weight of the fibrous elements, wherein the fibrous elements exhibit a diameter of less than 2 μm as measured according to the Diameter Test Method described herein and a contact angle of less than about 80° as measured according to the Contact Angle Test Method described herein; and b. associating the plurality of fibrous elements such that a fibrous structure is formed, is provided.

In still yet another example of the present invention, a method for activating a fibrous element, such as a filament, comprising the steps of:

a. providing a fibrous element, such as a filament, comprising a fibrous element-forming polymer and an activatable wetting agent present at a level of greater than 0% but less than 2% by weight of the fibrous element, wherein the fibrous element exhibits a diameter of less than 2 μm as measured according to the Diameter Test Method described herein and a contact angle of greater than 100° as measured according to the Contact Angle Test Method described herein; and b. activating the wetting agent such that the fibrous element exhibits a contact angle of less than 80° as measured according to the Contact Angle Test Method described herein, is provided.

In even still yet another example of the present invention, a package comprising a fibrous structure comprising a fibrous element comprising a fibrous element-forming polymer and an activatable wetting agent present at a level of greater than 0% but less than 2% by weight of the fibrous elements wherein the fibrous element exhibits a diameter of less than 2 μm as measured according to the Diameter Test Method described herein and a contact angle of greater than 100° as measured according to the Contact Angle Test Method described herein, the package further comprising instructions for activating the activatable wetting agent, is provided.

Accordingly, the present invention provides fibrous elements comprising a polymer and a wetting agent, methods for making fibrous elements, methods for making fibrous structures comprising such fibrous elements and packages comprising such fibrous structures.

DETAILED DESCRIPTION OF THE INVENTION

Definitions

Figure 1:
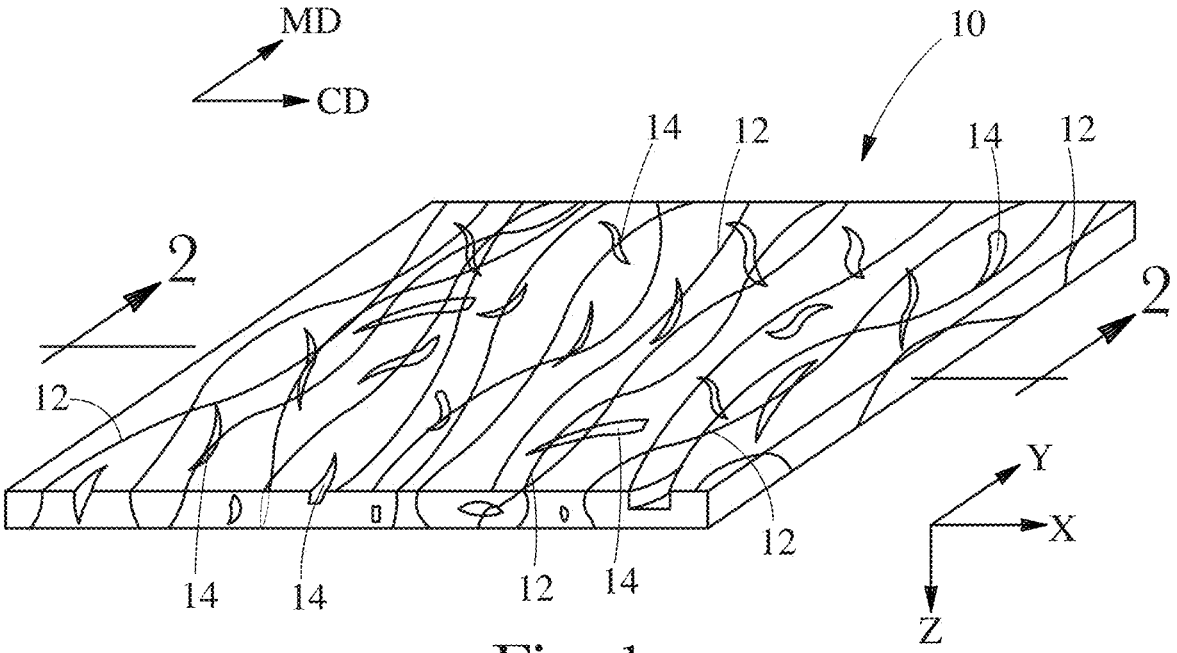
FIG. 1 is a schematic representation of an example of a fibrous structure according to the present invention.

"Fibrous element" as used herein means an elongate particulate having a length greatly exceeding its average diameter, i.e. a length to average diameter ratio of at least about 10. A fibrous element may be a filament or a fiber. In one example, the fibrous element is a single fibrous element rather than a yarn comprising a plurality of fibrous elements.

The fibrous elements of the present invention may be spun from spinning compositions such as polymer melt compositions, via suitable spinning operations, such as meltblowing and/or spunbonding and/or they may be obtained from natural sources such as vegetative sources, for example trees.

The fibrous elements of the present invention may be monocomponent or multicomponent. For example, the fibrous elements may comprise bicomponent fibers and/or filaments. The bicomponent fibers and/or filaments may be in any form, such as side-by-side, core and sheath, islands-in-the-sea and the like.

"Filament" as used herein means an elongate particulate as described above that exhibits a length of greater than or equal to 5.08 cm (2 in.) and/or greater than or equal to 7.62 cm (3 in.) and/or greater than or equal to 10.16 cm (4 in.) and/or greater than or equal to 15.24 cm (6 in.).

Filaments are typically considered continuous or substantially continuous in nature. Filaments are relatively longer than fibers. Non-limiting examples of filaments include meltblown and/or spunbond filaments.

"Fiber" as used herein means an elongate particulate as described above that exhibits a length of less than 5.08 cm (2 in.) and/or less than 3.81 cm (1.5 in.) and/or less than 2.54 cm (1 in.).

Fibers are typically considered discontinuous in nature. Non-limiting examples of fibers include pulp fibers, such as wood pulp fibers, and synthetic staple fibers such as polypropylene, polyethylene, polyester, copolymers thereof, rayon, glass fibers and polyvinyl alcohol fibers.

Staple fibers may be produced by spinning a filament tow and then cutting the tow into segments of less than 5.08 cm (2 in.) thus producing fibers.

In one example of the present invention, a fiber may be a naturally occurring fiber, which means it is obtained from a naturally occurring source, such as a vegetative source, for example a tree and/or plant. Such fibers are typically used in papermaking and are oftentimes referred to as papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories of fibers as well as other non-fibrous polymers such as fillers, softening agents, wet and dry strength agents, and adhesives used to facilitate the original papermaking.

In addition to the various wood pulp fibers, other cellulosic fibers such as cotton linters, rayon, lyocell and bagasse fibers can be used in the fibrous structures of the present invention.

"Fibrous structure" as used herein means a structure that comprises one or more filaments and/or fibers. In one example, a fibrous structure according to the present invention means an orderly arrangement of filaments and/or fibers within a structure in order to perform a function. In another example, a fibrous structure according to the present invention is a nonwoven.

The fibrous structures of the present invention may be homogeneous or may be layered. If layered, the fibrous structures may comprise at least two and/or at least three and/or at least four and/or at least five layers.

The fibrous structures of the present invention may be co-formed fibrous structures.

In one example, the fibrous structures of the present invention are disposable. For example, the fibrous structures of the present invention are non-textile fibrous structures. In another example, the fibrous structures of the present invention are flushable, such as toilet tissue.

Non-limiting examples of processes for making fibrous structures include known wet-laid papermaking processes and air-laid papermaking processes. Such processes typically include the steps of preparing a fibrous element composition, such as a fiber composition, in the form of a suspension in a medium, either wet, more specifically an aqueous medium, i.e., water, or dry, more specifically a gaseous medium, i.e. air. The suspension of fibers within an aqueous medium is oftentimes referred to as a fiber slurry. The fibrous suspension is then used to deposit a plurality of fibers onto a forming wire or belt such that an embryonic fibrous structure is formed, after which drying and/or bonding the fibers together results in the association of the fibers into a fibrous structure. Further processing the fibrous structure may be carried out such that a finished fibrous structure is formed. For example, in typical papermaking processes, the finished fibrous structure is the fibrous structure that is wound on the reel at the end of papermaking. The finished fibrous structure may subsequently be converted into a finished product, e.g. a sanitary tissue product.

In one example, the fibrous structure of the present invention is a "unitary fibrous structure."

"Unitary fibrous structure" as used herein is an arrangement comprising a plurality of two or more and/or three or more fibrous elements that are inter-entangled or otherwise associated with one another to form a fibrous structure. A unitary fibrous structure in accordance with the present invention may be incorporated into a fibrous structure according to the present invention. A unitary fibrous structure of the present invention may be one or more plies within a multi-ply fibrous structure. In one example, a unitary fibrous structure of the present invention may comprise three or more different fibrous elements. In another example, a unitary fibrous structure of the present invention may comprise two different fibrous elements, for example a co-formed fibrous structure, upon which a different fibrous element is deposited to form a fibrous structure comprising three or more different fibrous elements.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers and/or absorbent gel materials and/or filler particles and/or particulate spot bonding powders and/or clays, and filaments, such as polypropylene filaments.

"Solid additive" as used herein means a fiber and/or a particulate.

"Particulate" as used herein means a granular substance or powder.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). Non-limiting examples of suitable sanitary tissue products of the present invention include paper towels, bath tissue, facial tissue, napkins, baby wipes, adult wipes, wet wipes, cleaning wipes, polishing wipes, cosmetic wipes, car care wipes, wipes that comprise an active agent for performing a particular function, cleaning substrates for use with implements, such as a Swiffer® cleaning wipe/pad. The sanitary tissue product may be convolutedly wound upon itself about a core or without a core to form a sanitary tissue product roll.

In one example, the sanitary tissue product of the present invention comprises one or more fibrous structures according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets.

The sanitary tissue products of the present invention may comprises additives such as softening agents, temporary wet strength agents, permanent wet strength agents, bulk softening agents, lotions, silicones, wetting agents, latexes, patterned latexes and other types of additives suitable for inclusion in and/or on sanitary tissue products.

"Fibrous element-forming polymer" as used herein means a polymer that exhibits properties that make it suitable for spinning into a fibrous element, such as a filament.

"Polysaccharide polymer" as used herein means a natural polysaccharide, a polysaccharide derivative and/or a modified polysaccharide.

"Non-polysaccharide polymer" as used herein means a polymer that is not a polysaccharide polymer as defined herein.

"Wetting agent" as used herein means a material in present in and/or on a fibrous element of the present invention, wherein the material that lowers the surface tension of a liquid, such as water, coming into contact with a surface of the fibrous element, allowing easier spreading and lower interfacial tension between the liquid and the surface.

"Activatable" as used herein with reference to a wetting agent means that the wetting agent exhibits different properties depending on the conditions it may have been subjected to. For example, in one case, a wetting agent within a fibrous element may not make the fibrous element exhibit a contact angle of less than 80°, but after being subjected to a 120° F. at 60% relative humidity for 24 hours, the wetting agent does make the fibrous element exhibit a contact angle of less than 80°.

"Activated wetting agent" as used herein means an activatable wetting agent that causes a fibrous element to exhibit a contact angle of less than 80° after the wetting agent initially failed to cause the fibrous element to exhibit a contact angle of less than 80°.

"Non-thermoplastic" as used herein means, with respect to a material, such as a fibrous element as a whole and/or a polymer within a fibrous element, that the fibrous element and/or polymer exhibits no melting point and/or softening point, which allows it to flow under pressure, in the absence of a plasticizer, such as water, glycerin, sorbitol, urea and the like.

"Thermoplastic" as used herein means, with respect to a material, such as a fibrous element as a whole and/or a polymer within a fibrous element, that the fibrous element and/or polymer exhibits a melting point and/or softening point at a certain temperature, which allows it to flow under pressure, even in the absence of a plasticizer "Non-cellulose-containing" as used herein means that less than 5% and/or less than 3% and/or less than 1% and/or less than 0.1% and/or 0% by weight of cellulose polymer, cellulose derivative polymer and/or cellulose copolymer is present in fibrous element. In one example, "non-cellulose-containing" means that less than 5% and/or less than 3% and/or less than 1% and/or less than 0.1% and/or 0% by weight of cellulose polymer is present in a fibrous element of the present invention.

"Random mixture of polymers" as used herein means that two or more different polymers are randomly combined to form a fibrous element. Accordingly, two or more different polymers that are orderly combined to form a fibrous element, such as a core and sheath bicomponent fibrous element, is not a random mixture of different polymers for purposes of the present invention.

"Associate," "Associated," "Association," and/or "Associating" as used herein with respect to fibrous elements means combining, either in direct contact or in indirect contact, fibrous elements such that a fibrous structure is formed. In one example, the associated fibrous elements may be bonded together for example by adhesives and/or thermal bonds. In another example, the fibrous elements may be associated with one another by being deposited onto the same fibrous structure making belt and/or patterned belt.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Diameter" as used herein, with respect to a fibrous element, is measured according to the Diameter Test Method described herein. In one example, a fibrous element, such as a filament, of the present invention exhibits a diameter of less than 2 μm and/or less than 1.5 μm and/or less than 1 μm and/or greater than 0.01 μm and/or greater than 0.1 μm and/or greater than 0.5 μm as measured according to the Diameter Test Method described herein.

"Basis Weight" as used herein is the weight per unit area of a sample reported in lbs/3000 $ft^2$ or $g/m^2$.

"Ply" or "Plies" as used herein means an individual fibrous structure optionally to be disposed in a substantially contiguous, face-to-face relationship with other plies, forming a multiple ply fibrous structure. It is also contemplated that a single fibrous structure can effectively form two "plies" or multiple "plies", for example, by being folded on itself.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Fibrous Elements

The fibrous elements of the present invention may be synthetic. In other words, the fibrous elements of the present invention may be "human-made" rather than naturally occurring (found in nature). The fibrous elements of the present invention comprise a polymer and a wetting agent. The polymer may be a fibrous element-forming polymer. The fibrous elements of the present invention may comprise greater than 30% and/or greater than 40% and/or greater than 50% and/or greater than 60% and/or greater than 70% to about 100% and/or to about 95% and/or to about 90% by weight of the filament of one or more polymers.

The fibrous elements of the present invention may comprise greater than 0% and/or greater than 0.5% and/or greater than 0.75% to less than 2% and/or less than 1.75% and/or less than 1.5% by weight of the fibrous elements of one or more wetting agents.

The fibrous elements of the present invention may associate to form a fibrous structure of the present invention.

In one example, the fibrous element comprises a filament.

The fibrous elements may be a single component (i.e., single synthetic material or mixture makes up entire fibrous element), bi-component (i.e., the fibrous element is divided into regions, the regions including two or more different polymers or mixtures thereof and may include co-extruded fibrous elements) and mixtures thereof. It is also possible to use bicomponent fibrous elements, or simply bicomponent or sheath polymers. These bicomponent fibrous elements can be used as a component fibrous element of the structure, and/or they may be present to act as a binder for other fibrous elements present in the fibrous structure. Any or all of the fibrous elements may be treated before, during, or after the process of the present invention to change any desired properties of the fibrous elements. For example, in certain embodiments, it may be desirable to treat (for example, make the fibrous elements less hydrophobic or more hydrophilic) the fibrous elements before, during or after making the fibrous elements and/or before, during or after making a fibrous structure.

Polymer

Non-limiting examples of suitable polymers for use in the fibrous elements of the present invention include polyolefins. In another example, the polymer of the present invention may be selected from the group consisting of: polyesters, polypropylenes, polyethylenes, polyethers, polyamides, polyhydroxyalkanoates, polysaccharides, polyvinyl alcohol, copolymers thereof, and mixtures thereof. A non-limiting example of a suitable polyester comprises polyethylene terephthalate.

In one example, the polymer is a non-polysaccharide polymer. The non-polysaccharide polymer of the present invention, which, for purposes of the present invention, does not include cellulose, cellulose derivatives, hemicellulose, hemicellulose derivatives, starch and starch derivatives. In addition to the non-polysaccharide polymers, the filaments may comprise polysaccharide polymers. Non-limiting examples of suitable polysaccharide polymers include starch, starch derivatives, cellulose, cellulose derivatives, hemicellulose, hemicellulose derivatives and mixtures thereof. The polysaccharide polymers may exhibit a weight average molecular weight of from about 10,000 g/mol to about 40,000,000 g/mol and/or greater than about 100,000 g/mol and/or greater than about 1,000,000 g/mol and/or greater than about 3,000,000 g/mol and/or greater than about 3,000,000 g/mol to about 40,000,000 g/mol.

The polymer of the present invention may be a thermoplastic polymer. The thermoplastic polymer of the present invention may be a biodegradable polymer, such as polylactic acid, polyhydroxyalkanoate, polycaprolactone, polyesteramides and certain polyesters.

Any suitable weight average molecular weight for the polymer of the present invention may be used. For example, the weight average molecular weight for a non-polysaccharide polymer in accordance with the present invention is greater than 10,000 g/mol and/or greater than 40,000 g/mol and/or greater than 50,000 g/mol and/or less than 500,000 g/mol and/or less than 400,000 g/mol and/or less than 200,000 g/mol. In one example, the polypropylene present in the polypropylene fibrous elements exhibits a weight average molecular weight of at least 78,000 g/mol and/or at least 80,000 g/mol and/or at least 82,000 g/mol and/or at least 85,000 g/mol and/or to about 500,000 g/mol and/or to about 400,000 g/mol and/or to about 200,000 g/mol and/or to about 100,000 g/mol.

The polypropylene present in the polypropylene fibrous elements may exhibit a polydispersity of less than 3.2 and/or less than 3.1 and/or less than 3.0, is provided.

Fibrous elements, such as filaments, comprising the polymers of the present invention, in the absence of a wetting agent, may exhibit a conditioned contact angle of greater than 100° and/or a contact angle greater than 110° as measured according to the Contact Angle Test Method described herein.

Wetting Agent

The wetting agent of the present invention may comprise any suitable wetting agent that can be added to a composition, such as a spinning composition, comprising a polymer, such as a fibrous element-forming polymer. In one example, the wetting agent is present in a spinning composition comprising the polymer prior to spinning a filament from the spinning composition. In one example, the wetting agent may be in an "unactivated state," meaning that its presence in and/or on the filament is not resulting in the filament exhibiting a contact angle of less than 80° as measured according to the Contact Angle Test Method. In another example, the wetting agent may be in an "activated state," meaning that its presence in and/or on the filament is resulting in the filament exhibiting a contact angle of less than 80° as measured according to the Contact Angle Test Method.

Non-limiting examples of suitable wetting agents include surfactants, such as silicone surfactants, polyethylene glycols, glycols and mixtures thereof. One commercially available wetting agent suitable for the present invention is sold under the trade name Polvyvel S1-1416 by Polyvel Inc. of Hammonton, N.J., which is sold as 20% active wetting agent. Any suitable wetting agent may be used so long as its presence in the fibrous elements produces the fibrous elements according to the present invention.

In one example, the fibrous element of the present invention is void of surface treating wetting agents that are applied (in an amount to cause the fibrous element to exhibit a contact angle of less than 80°) to an external surface of the fibrous element.

Fibrous Structures

The fibrous structures of the present invention may comprises a plurality of fibrous elements. In one example, a fibrous structure of the present invention comprises a plurality of filaments, such as polypropylene filaments. In another example, a fibrous structure of the present invention may comprise a plurality of filaments, such as polypropylene filaments, and a plurality of solid additives, such as wood pulp fibers. The fibrous structures of the present invention have been found to exhibit consumer-recognizable beneficial absorbent capacity.

Figure 2:
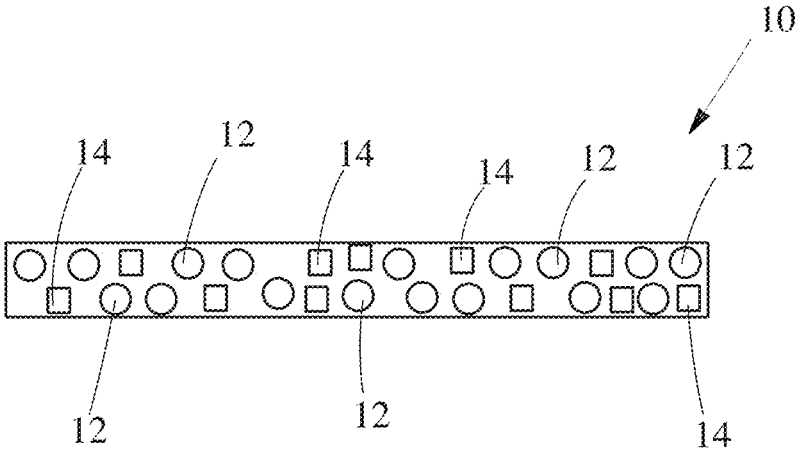
FIG. 2 is a schematic, cross-sectional representation of FIG. 1 taken along line 2-2.

FIGS. 1 and 2 show schematic representations of an example of a fibrous structure in accordance with the present invention. As shown in FIGS. 1 and 2, the fibrous structure 10 may be a co-formed fibrous structure. The fibrous structure 10 comprises a plurality of filaments 12, such as polypropylene filaments, and a plurality of solid additives, such as wood pulp fibers 14. The filaments 12 may be randomly arranged as a result of the process by which they are spun and/or formed into the fibrous structure 10. The wood pulp fibers 14, may be randomly dispersed throughout the fibrous structure 10 in the x-y plane. The wood pulp fibers 14 may be non-randomly dispersed throughout the fibrous structure in the z-direction. In one example (not shown), the wood pulp fibers 14 are present at a higher concentration on one or more of the exterior, x-y plane surfaces than within the fibrous structure along the z-direction.

Figure 3:
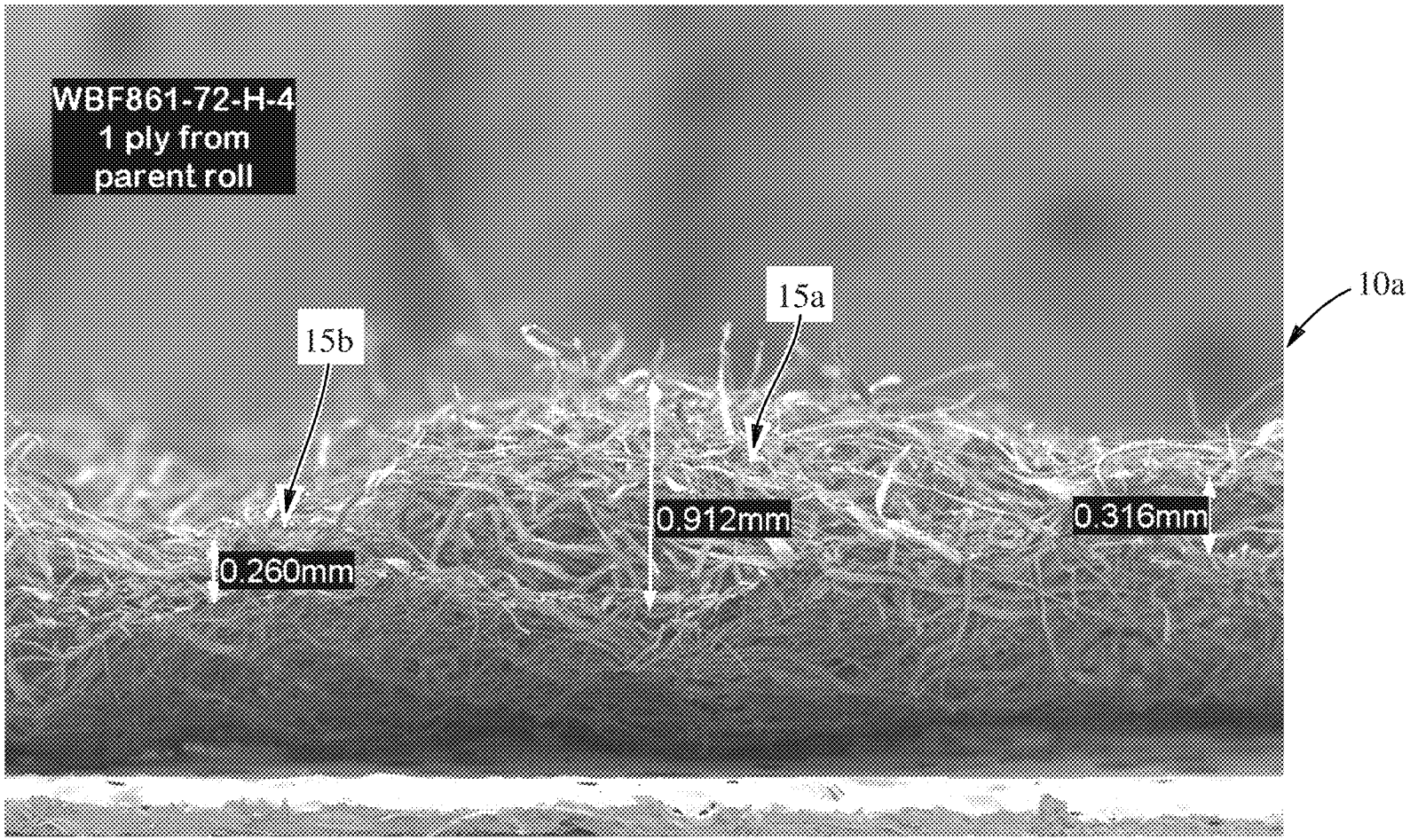
FIG. 3 is a scanning electromicrophotograph of a cross-section of another example of fibrous structure according to the present invention.

FIG. 3 shows a cross-sectional, SEM microphotograph of another example of a fibrous structure 10*a* in accordance with the present invention shows a fibrous structure 10*a* comprising a non-random, repeating pattern of microregions 15*a* and 15*b*. The microregion 15*a* (typically referred to as a "pillow") exhibits a different value of a common intensive property than microregion 15*b* (typically referred to as a "knuckle"). In one example, the microregion 15*b* is a continuous or semi-continuous network and the microregion 15*a* are discrete regions within the continuous or semi-continuous network. The common intensive property may be caliper. In another example, the common intensive property may be density.

Figure 4:
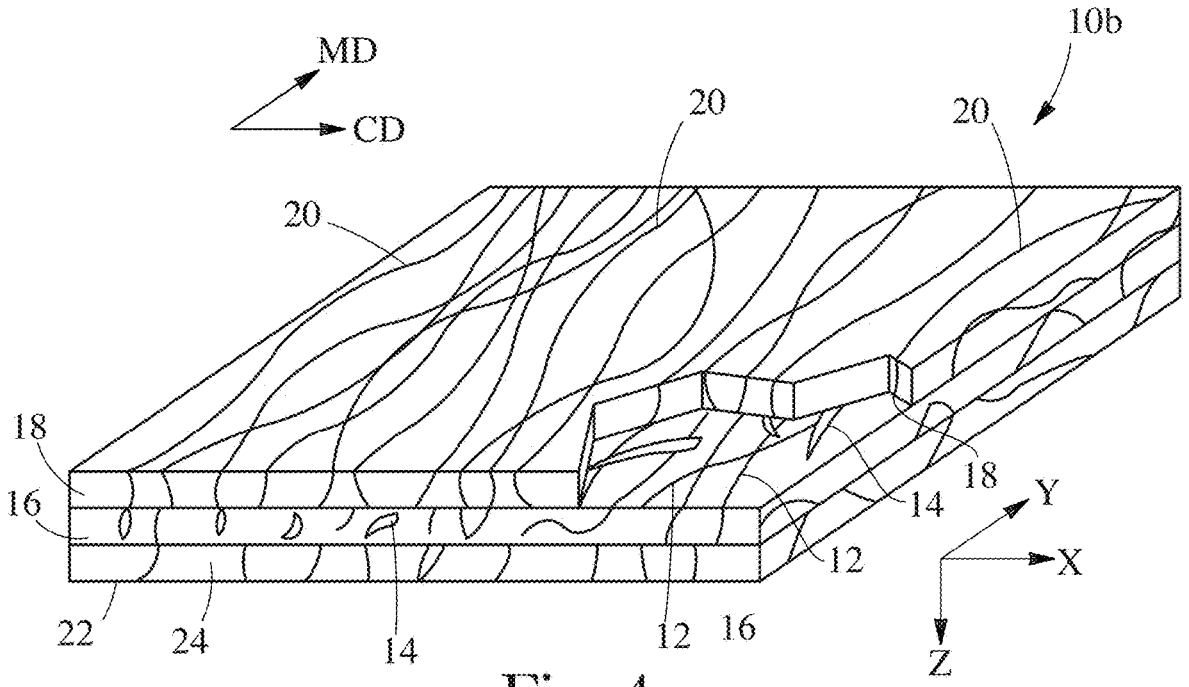
FIG. 4 is a schematic representation of another example of a fibrous structure according to the present invention.

As shown in FIG. 4, another example of a fibrous structure in accordance with the present invention is a layered fibrous structure 10*b*. The layered fibrous structure 10*b* comprises a first layer 16 comprising a plurality of filaments 12, such as polypropylene filaments, and a plurality of solid additives, in this example, wood pulp fibers 14. The layered fibrous structure 10*b* further comprises a second layer 18 comprising a plurality of filaments 20, such as polypropylene filaments. In one example, the first and second layers 16, 18, respectively, are sharply defined zones of concentration of the filaments and/or solid additives. The plurality of filaments 20 may be deposited directly onto a surface of the first layer 16 to form a layered fibrous structure that comprises the first and second layers 16, 18, respectively.

Further, the layered fibrous structure 10*b* may comprise a third layer 22, as shown in FIG. 4. The third layer 22 may comprise a plurality of filaments 24, which may be the same or different from the filaments 20 and/or 16 in the second 18 and/or first 16 layers. As a result of the addition of the third layer 22, the first layer 16 is positioned, for example sandwiched, between the second layer 18 and the third layer 22. The plurality of filaments 24 may be deposited directly onto a surface of the first layer 16, opposite from the second layer, to form the layered fibrous structure 10*b* that comprises the first, second and third layers 16, 18, 22, respectively.

Figure 5:
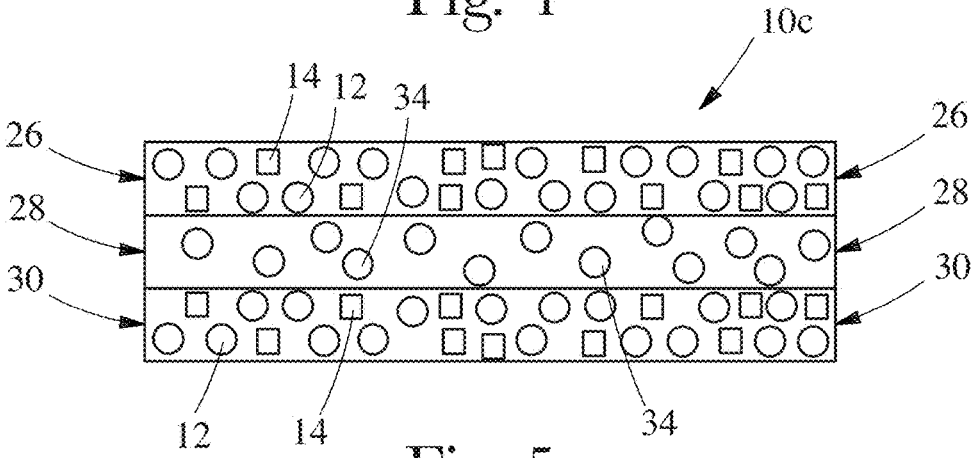
FIG. 5 is a schematic, cross-sectional representation of another example of a fibrous structure according to the present invention.

As shown in FIG. 5, a cross-sectional schematic representation of another example of a fibrous structure in accordance with the present invention comprising a layered fibrous structure 10*c* is provided. The layered fibrous structure 10*c* comprises a first layer 26, a second layer 28 and optionally a third layer 30. The first layer 26 comprises a plurality of filaments 12, such as polypropylene filaments, and a plurality of solid additives, such as wood pulp fibers 14. The second layer 28 may comprise any suitable filaments, solid additives and/or polymeric films. In one example, the second layer 28 comprises a plurality of filaments 34. In one example, the filaments 34 comprise a polymer selected from the group consisting of: polysaccharides, polysaccharide derivatives, polyvinylalcohol, polyvinylalcohol derivatives and mixtures thereof.

In another example of a fibrous structure in accordance with the present invention, instead of being layers of fibrous structure 10*c*, the material forming layers 26, 28 and 30, may be in the form of plies wherein two or more of the plies may be combined to form a fibrous structure. The plies may be bonded together, such as by thermal bonding and/or adhesive bonding, to form a multi-ply fibrous structure.

Figure 6:
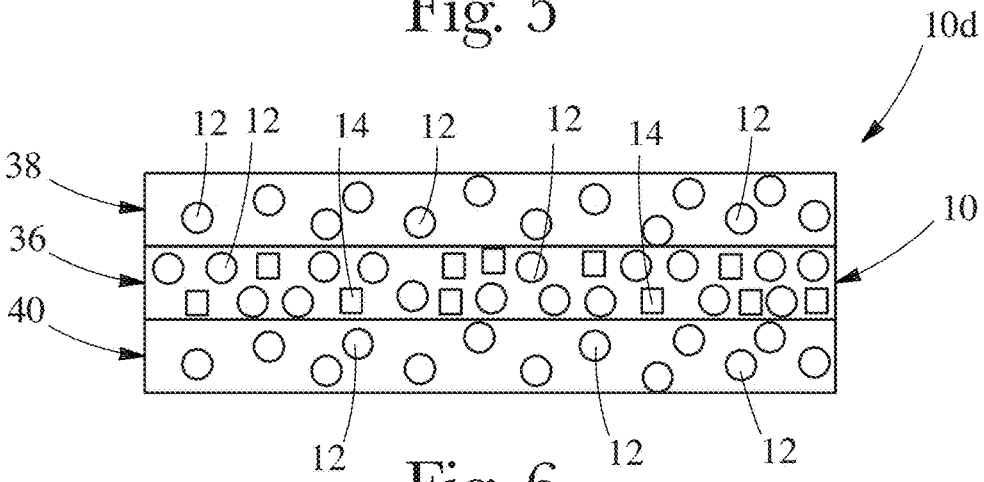
FIG. 6 is a schematic, cross-sectional representation of another example of a fibrous structure according to the present invention.

Another example of a fibrous structure of the present invention in accordance with the present invention is shown in FIG. 6. The fibrous structure 10*d* may comprise two or more plies, wherein one ply 36 comprises any suitable fibrous structure in accordance with the present invention, for example fibrous structure 10 as shown and described in FIGS. 1 and 2 and another ply 38 comprising any suitable fibrous structure, for example a fibrous structure comprising filaments 12, such as polypropylene filaments. The fibrous structure of ply 38 may be in the form of a net and/or mesh and/or other structure that comprises pores that expose one or more portions of the fibrous structure 10*d* to an external environment and/or at least to liquids that may come into contact, at least initially, with the fibrous structure of ply 38. In addition to ply 38, the fibrous structure 10*d* may further comprise ply 40. Ply 40 may comprise a fibrous structure comprising filaments 12, such as polypropylene filaments, and may be the same or different from the fibrous structure of ply 38.

Two or more of the plies 36, 38 and 40 may be bonded together, such as by thermal bonding and/or adhesive bonding, to form a multi-ply fibrous structure. After a bonding operation, especially a thermal bonding operation, it may be difficult to distinguish the plies of the fibrous structure 10*d* and the fibrous structure 10*d* may visually and/or physically be a similar to a layered fibrous structure in that one would have difficulty separating the once individual plies from each other. In one example, ply 36 may comprise a fibrous structure that exhibits a basis weight of at least about 15 $g/m^2$ and/or at least about 20 $g/m^2$ and/or at least about 25 $g/m^2$ and/or at least about 30 $g/m^2$ up to about 120 $g/m^2$ and/or 100 $g/m^2$ and/or 80 $g/m^2$ and/or 60 $g/m^2$ and the plies 38 and 42, when present, independently and individually, may comprise fibrous structures that exhibit basis weights of less than about 10 $g/m^2$ and/or less than about 7 $g/m^2$ and/or less than about 5 $g/m^2$ and/or less than about 3 $g/m^2$ and/or less than about 2 $g/m^2$ and/or to about 0 $g/m^2$ and/or 0.5 $g/m^2$.

Plies 38 and 40, when present, may help retain the solid additives, in this case the wood pulp fibers 14, on and/or within the fibrous structure of ply 36 thus reducing lint and/or dust (as compared to a single-ply fibrous structure comprising the fibrous structure of ply 36 without the plies 38 and 40) resulting from the wood pulp fibers 14 becoming free from the fibrous structure of ply 36.

The fibrous structures of the present invention may comprise any suitable amount of filaments and any suitable amount of solid additives. For example, the fibrous structures may comprise from about 10% to about 70% and/or from about 20% to about 60% and/or from about 30% to about 50% by dry weight of the fibrous structure of filaments and from about 90% to about 30% and/or from about 80% to about 40% and/or from about 70% to about 50% by dry weight of the fibrous structure of solid additives, such as wood pulp fibers.

In one example, the fibrous structures of the present invention comprise less than 30% and/or less than 25% and/or less than 20% and/or less than 15% and/or to about 10% by weight of the fibrous structure of filaments.

In one example, the fibrous structures of the present invention may comprise at least 70% and/or at least 75% and/or at least 80% and/or at least 85% and/or to about 90% by weight of the fibrous structures of solid additives, such as fibers.

The filaments and solid additives of the present invention may be present in fibrous structures according to the present invention at weight ratios of filaments to solid additives of from at least about 1:1 and/or at least about 1:1.5 and/or at least about 1:2 and/or at least about 1:2.5 and/or at least about 1:3 and/or at least about 1:4 and/or at least about 1:5 and/or at least about 1:7 and/or at least about 1:10.

The fibrous structures of the present invention and/or any sanitary tissue products comprising such fibrous structures may be subjected to any post-processing operations such as embossing operations, printing operations, tuft-generating operations, thermal bonding operations, ultrasonic bonding operations, perforating operations, surface treatment operations such as application of lotions, silicones and/or other materials and mixtures thereof.

Non-limiting examples of suitable polypropylenes for making the filaments of the present invention are commercially available from Lyondell-Basell and Exxon-Mobil.

Any hydrophobic or non-hydrophilic materials within the fibrous structure, such as polypropylene filaments, may be surface treated and/or melt treated with a hydrophilic modifier. Non-limiting examples of surface treating hydrophilic modifiers include surfactants, such as Triton X-100. Non-limiting examples of melt treating hydrophilic modifiers that are added to the melt, such as the polypropylene melt, prior to spinning filaments, include hydrophilic modifying melt additives such as VW351 and/or S-1416 commercially available from Polyvel, Inc. and Irgasurf commercially available from Ciba. The hydrophilic modifier may be associated with the hydrophobic or non-hydrophilic material at any suitable level known in the art. In one example, the hydrophilic modifier is associated with the hydrophobic or non-hydrophilic material at a level of less than about 20% and/or less than about 15% and/or less than about 10% and/or less than about 5% and/or less than about 3% to about 0% by dry weight of the hydrophobic or non-hydrophilic material.

The filaments and/or fibrous structures containing the filaments of the present invention exhibit a contact angle of less than 80° and/or less than 75° and/or less than 65° and/or less than 50° as measured by the Contact Angle Test Method described herein.

The fibrous structures of the present invention may include optional additives, each, when present, at individual levels of from about 0% and/or from about 0.01% and/or from about 0.1% and/or from about 1% and/or from about 2% to about 95% and/or to about 80% and/or to about 50% and/or to about 30% and/or to about 20% by dry weight of the fibrous structure. Non-limiting examples of optional additives include permanent wet strength agents, temporary wet strength agents, dry strength agents such as carboxymethylcellulose and/or starch, softening agents, lint reducing agents, opacity increasing agents, wetting agents, odor absorbing agents, perfumes, temperature indicating agents, color agents, dyes, osmotic materials, microbial growth detection agents, antibacterial agents and mixtures thereof.

The fibrous structure of the present invention may itself be a sanitary tissue product. It may be convolutedly wound about a core to form a roll. It may be combined with one or more other fibrous structures as a ply to form a multi-ply sanitary tissue product. In one example, a co-formed fibrous structure of the present invention may be convolutedly wound about a core to form a roll of co-formed sanitary tissue product. The rolls of sanitary tissue products may also be coreless.

Method for Making a Fibrous Element

The fibrous elements of the present invention, for example the filaments of the present invention, may be made by any suitable method for spinning fibrous elements, such as filaments.

For example, filaments of the present invention may be created by meltblowing a spinning composition comprising a polymer, such as a filament-forming polymer, and a wetting agent from a meltblow die. Non-limiting examples of commercially available meltblow dies are Biax-Fiberfilm's (Greenville, Wis.) meltblow dies and knife-edge dies.

Method for Making a Fibrous Structure

Figure 7:
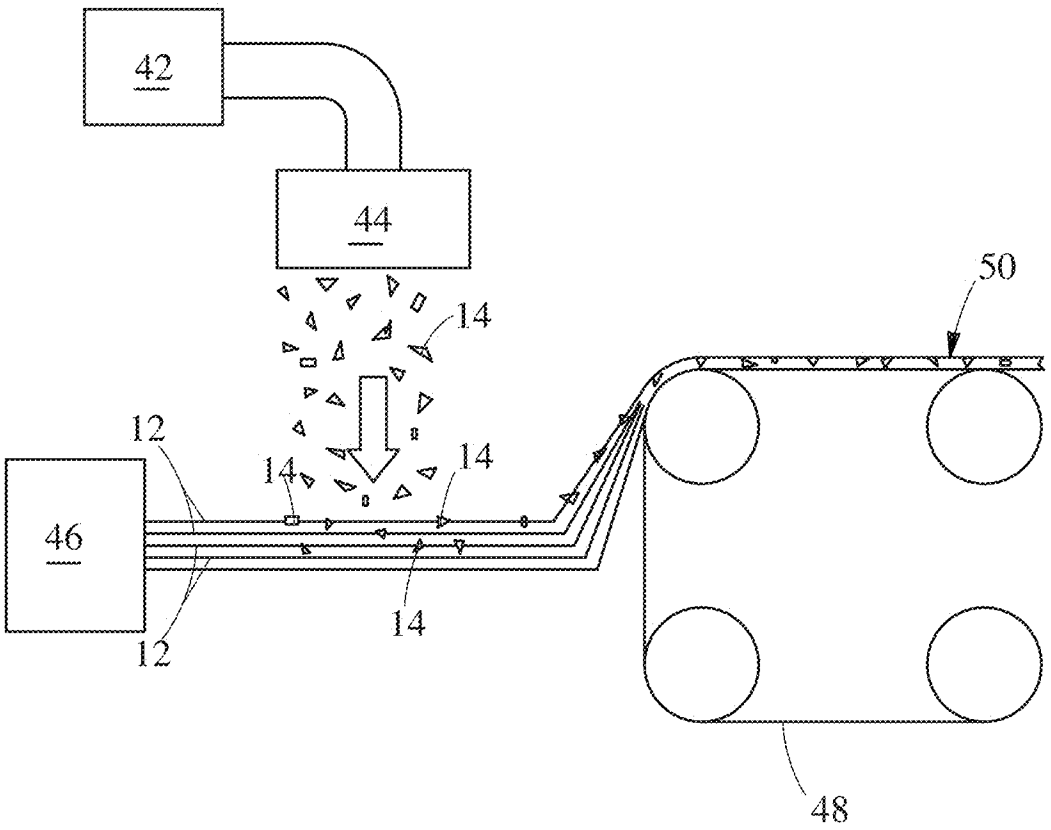
FIG. 7 is a schematic representation of an example of a process for making a fibrous structure according to the present invention.
Figure 8:
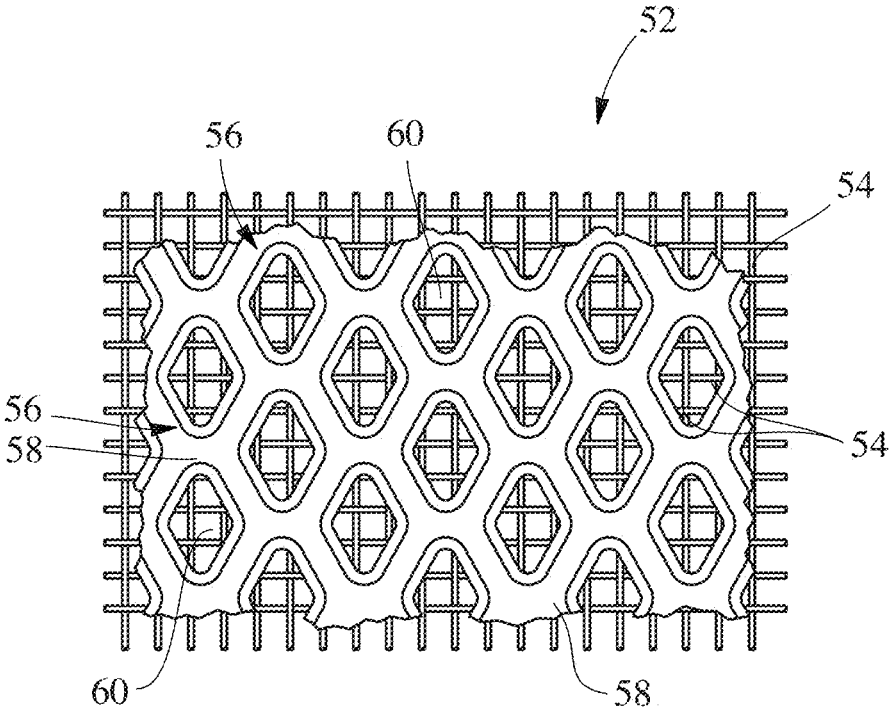
FIG. 8 is a schematic representation of an example of a patterned belt for use in a process according to the present invention.

A non-limiting example of a method for making a fibrous structure according to the present invention is represented in FIG. 7. The method shown in FIG. 7 comprises the step of mixing a plurality of solid additives 14 with a plurality of filaments 12 made from a polymer melt composition comprising polypropylene and a wetting agent. In one example, the solid additives 14 are wood pulp fibers, such as SSK fibers and/or Eucalyptus fibers, and the filaments 12 are polypropylene filaments. The solid additives 14 may be combined with the filaments 12, such as by being delivered to a stream of filaments 12 from a hammermill 42 via a solid additive spreader 44 to form a mixture of filaments 12 and solid additives 14. The filaments 12 may be created by meltblowing from a meltblow die 46. The mixture of solid additives 14 and filaments 12 are collected on a collection device, such as a belt 48 to form a fibrous structure 50. The collection device may be a patterned and/or molded belt that results in the fibrous structure exhibiting a surface pattern, such as a non-random, repeating pattern of microregions. The patterned belt may have a three-dimensional pattern on it that gets imparted to the fibrous structure 50 during the process. For example, the patterned belt 52, as shown in FIG. 8, may comprise a reinforcing structure, such as a fabric 54, upon which a polymer resin 56 is applied in a pattern. The pattern may comprise a continuous or semi-continuous network 58 of the polymer resin 56 within which one or more discrete conduits 60 are arranged.

In one example of the present invention, the fibrous structures are made using a die comprising at least one filament-forming hole, and/or 2 or more and/or 3 or more rows of filament-forming holes from which filaments are spun. At least one row of holes contains 2 or more and/or 3 or more and/or 10 or more filament-forming holes. In addition to the filament-forming holes, the die comprises fluid-releasing holes, such as gas-releasing holes, in one example air-releasing holes, that provide attenuation to the filaments formed from the filament-forming holes. One or more fluid-releasing holes may be associated with a filament-forming hole such that the fluid exiting the fluid-releasing hole is parallel or substantially parallel (rather than angled like a knife-edge die) to an exterior surface of a filament exiting the filament-forming hole. In one example, the fluid exiting the fluid-releasing hole contacts the exterior surface of a filament formed from a filament-forming hole at an angle of less than 30° and/or less than 20° and/or less than 10° and/or less than 5° and/or about 0°. One or more fluid releasing holes may be arranged around a filament-forming hole. In one example, one or more fluid-releasing holes are associated with a single filament-forming hole such that the fluid exiting the one or more fluid releasing holes contacts the exterior surface of a single filament formed from the single filament-forming hole. In one example, the fluid-releasing hole permits a fluid, such as a gas, for example air, to contact the exterior surface of a filament formed from a filament-forming hole rather than contacting an inner surface of a filament, such as what happens when a hollow filament is formed.

Figure 9:
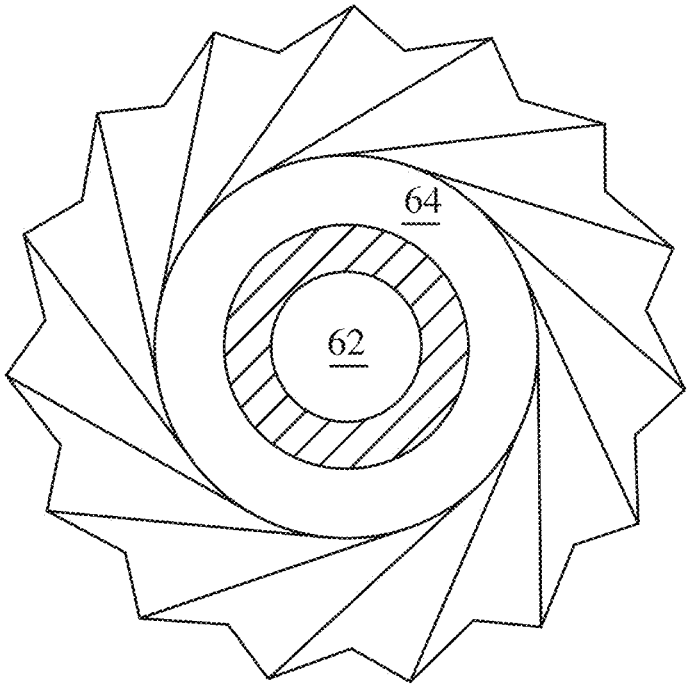
FIG. 9 is a schematic representation of an example of a filament-forming hole and fluid-releasing hole from a suitable die useful in making a fibrous structure according to the present invention.

In one example, the die comprises a filament-forming hole positioned within a fluid-releasing hole. The fluid-releasing hole 62 may be concentrically or substantially concentrically positioned around a filament-forming hole 64 such as is shown in FIG. 9.

After the fibrous structure 50 has been formed on the collection device, the fibrous structure 50 may be calendered, for example, while the fibrous structure is still on the collection device. In addition, the fibrous structure 50 may be subjected to post-processing operations such as embossing, thermal bonding, tuft-generating operations, moisture-imparting operations, and surface treating operations to form a finished fibrous structure. One example of a surface treating operation that the fibrous structure may be subjected to is the surface application of an elastomeric binder, such as ethylene vinyl acetate (EVA), latexes, and other elastomeric binders. Such an elastomeric binder may aid in reducing the lint created from the fibrous structure during use by consumers. The elastomeric binder may be applied to one or more surfaces of the fibrous structure in a pattern, especially a non-random, repeating pattern of microregions, or in a manner that covers or substantially covers the entire surface (s) of the fibrous structure.

In one example, the fibrous structure 50 and/or the finished fibrous structure may be combined with one or more other fibrous structures. For example, another fibrous structure, such as a filament-containing fibrous structure, such as a polypropylene filament fibrous structure may be associated with a surface of the fibrous structure 50 and/or the finished fibrous structure. The polypropylene filament fibrous structure may be formed by meltblowing polypropylene filaments (filaments that comprise a second polymer that may be the same or different from the polymer of the filaments in the fibrous structure 50) onto a surface of the fibrous structure 50 and/or finished fibrous structure. In another example, the polypropylene filament fibrous structure may be formed by meltblowing filaments comprising a second polymer that may be the same or different from the polymer of the filaments in the fibrous structure 50 onto a collection device to form the polypropylene filament fibrous structure. The polypropylene filament fibrous structure may then be combined with the fibrous structure 50 or the finished fibrous structure to make a two-ply fibrous structure—three-ply if the fibrous structure 50 or the finished fibrous structure is positioned between two plies of the polypropylene filament fibrous structure like that shown in FIG. 6 for example. The polypropylene filament fibrous structure may be thermally bonded to the fibrous structure 50 or the finished fibrous structure via a thermal bonding operation.

In yet another example, the fibrous structure 50 and/or finished fibrous structure may be combined with a filament-containing fibrous structure such that the filament-containing fibrous structure, such as a polysaccharide filament fibrous structure, such as a starch filament fibrous structure, is positioned between two fibrous structures 50 or two finished fibrous structures like that shown in FIG. 6 for example.

In still another example, two plies of fibrous structure 50 comprising a non-random, repeating pattern of microregions may be associated with one another such that protruding microregions, such as pillows, face inward into the two-ply fibrous structure formed.

The process for making fibrous structure 50 may be close coupled (where the fibrous structure is convolutedly wound into a roll prior to proceeding to a converting operation) or directly coupled (where the fibrous structure is not convolutedly wound into a roll prior to proceeding to a converting operation) with a converting operation to emboss, print, deform, surface treat, or other post-forming operation known to those in the art. For purposes of the present invention, direct coupling means that the fibrous structure 50 can proceed directly into a converting operation rather than, for example, being convolutedly wound into a roll and then unwound to proceed through a converting operation.

The process of the present invention may include preparing individual rolls of fibrous structure and/or sanitary tissue product comprising such fibrous structure(s) that are suitable for consumer use.

Non-Limiting Example of Method for Making a Fibrous Structure

A 20%:27.5%47.5%:5% blend of Lyondell-Basell PH835 polypropylene:Lyondell-Basell Metocene MF650W polypropylene:Exxon-Mobil PP3546 polypropylene:Polyvel S-1416 wetting agent (20% of the 5% is wetting agent) is dry blended, to form a melt blend. The melt blend is heated to 475° F. through a melt extruder. A 15.5 inch wide Biax 12 row spinnerette with 192 nozzles per cross-direction inch, commercially available from Biax Fiberfilm Corporation, is utilized. 40 nozzles per cross-direction inch of the 192 nozzles have a 0.018 inch inside diameter while the remaining nozzles are solid, i.e. there is no opening in the nozzle. Approximately 0.19 grams per hole per minute (ghm) of the melt blend is extruded from the open nozzles to form meltblown filaments from the melt blend. Approximately 375 SCFM of compressed air is heated such that the air exhibits a temperature of 395° F. at the spinnerette. Approximately 475 g/minute of Golden Isle (from Georgia Pacific) 4825 semi-treated SSK pulp is defibrillated through a hammermill to form SSK wood pulp fibers (solid additive). Air at 85-90° F. and 85% relative humidity (RH) is drawn into the hammermill. Approximately 1200 SCFM of air carries the pulp fibers to a solid additive spreader. The solid additive spreader turns the pulp fibers and distributes the pulp fibers in the cross-direction such that the pulp fibers are injected into the meltblown filaments in a perpendicular fashion through a 4 inch×15 inch cross-direction (CD) slot. A forming box surrounds the area where the meltblown filaments and pulp fibers are commingled. This forming box is designed to reduce the amount of air allowed to enter or escape from this commingling area; however, there is an additional 4 inch×15 inch spreader opposite the solid additive spreader designed to add cooling air. Approximately 1000 SCFM of air at approximately 80° F. is added through this additional spreader. A forming vacuum pulls air through a collection device, such as a patterned belt, thus collecting the commingled meltblown filaments and pulp fibers to form a fibrous structure comprising a pattern of non-random, repeating microregions. The fibrous structure formed by this process comprises about 75% by dry fibrous structure weight of pulp and about 25% by dry fibrous structure weight of meltblown filaments.

Figure 10:
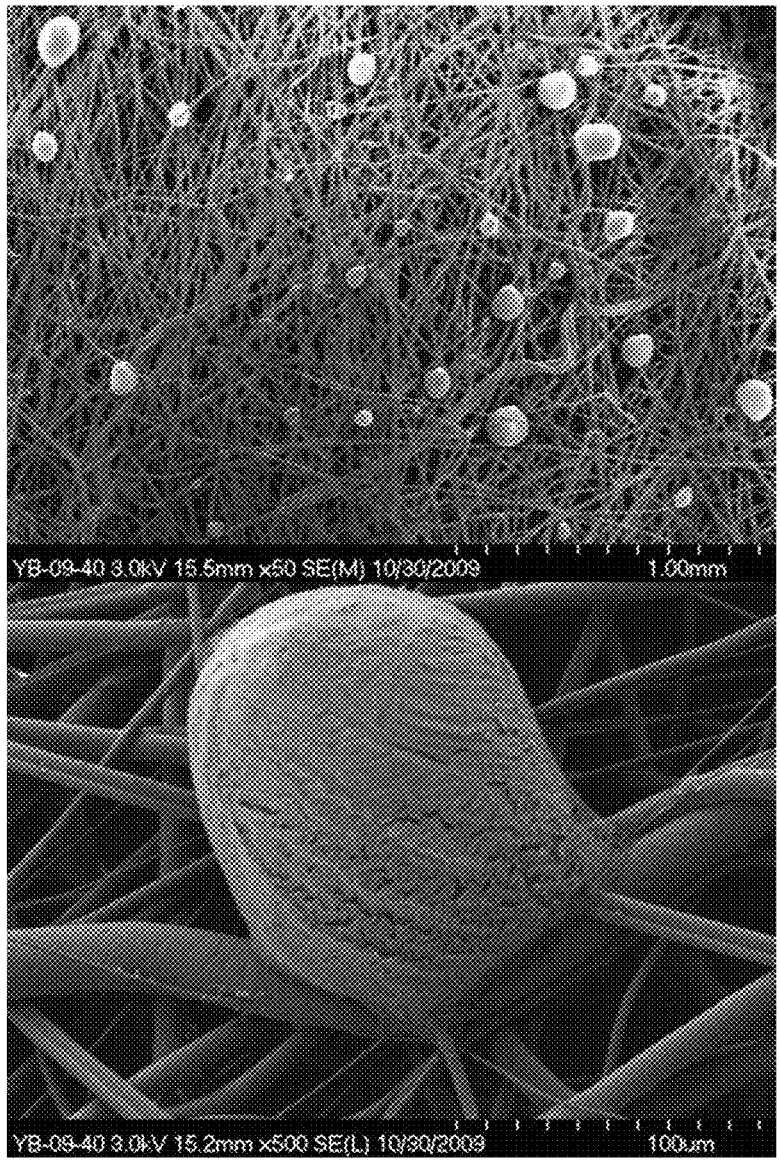
FIG. 10 are cryo-scanning electromicrographs of an example of a fibrous structure of the present invention prior to activation of the wetting agent within the polypropylene filaments.
Figure 11:
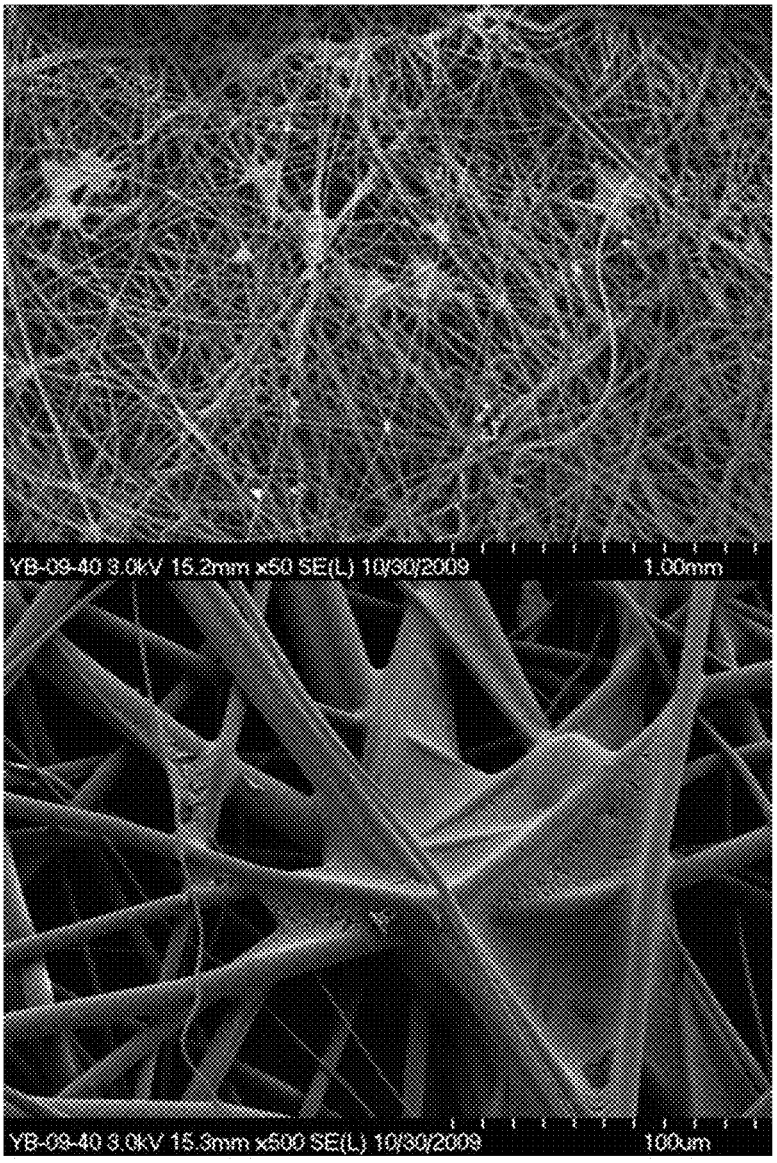
FIG. 11 are cryo-scanning electromicrographs of the fibrous structure of FIG. 10 after activation of the wetting agent within the polypropylene filaments.

FIG. 10 shows cryo-scanning electromicrographs of the fibrous structure made as described above without the solid additives and prior to activation of the wetting agent within the polypropylene filaments. The fibrous structure of FIG. 10 exhibited a contact angle of about 135° as measured by the Contact Angle Test Method described herein. FIG. 11 shows cryo-scanning electromicrographs of the fibrous structure of FIG. 10 after activation of the wetting agent within the polypropylene filaments by subjecting the fibrous structure to 120° F. at a relative humidity of 60% for 24 hours. The fibrous structure of FIG. 11 exhibited a contact angle of about 43° as measured according to the Contact Angle Test Method described herein.

Optionally, a meltblown layer of the meltblown filaments can be added to one or both sides of the above formed fibrous structure. This addition of the meltblown layer can help reduce the lint created from the fibrous structure during use by consumers and is preferably performed prior to any thermal bonding operation of the fibrous structure. The meltblown filaments for the exterior layers can be the same or different than the meltblown filaments used on the opposite layer or in the center layer(s).

The fibrous structure may be convolutedly wound to form a roll of fibrous structure.

Test Methods

Unless otherwise indicated, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. Samples conditioned as described herein are considered dry samples (such as "dry fibrous structures") for purposes of this invention. Further, all tests are conducted in such conditioned room.

Elongation, Tensile Strength, TEA and Modulus Test Methods

Cut at least eight 1 inch wide strips of the fibrous structure and/or sanitary tissue product to be tested in the machine direction. Cut at least eight 1 inch wide strips in the cross direction. If the machine direction and cross direction are not readily ascertainable, then the cross direction will be the strips that result in the lower peak load tensile. For the wet measurements, each sample is wetted by submerging the sample in a distilled water bath for 30 seconds. The wet property of the wet sample is measured within 30 seconds of removing the sample from the bath.

For the actual measurements of the properties, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min and the 1st and 2nd gauge lengths to 4.00 inches. The break sensitivity is set to 20.0 grams and the sample width is set to 1.00 inch. The energy units are set to TEA and the tangent modulus (Modulus) trap setting is set to 38.1 g.

After inserting the fibrous structure sample strip into the two clamps, the instrument tension can be monitored. If it shows a value of 5 grams or more, the fibrous structure sample strip is too taut. Conversely, if a period of 2-3 seconds passes after starting the test before any value is recorded, the fibrous structure sample strip is too slack.

Start the tensile tester as described in the tensile tester instrument manual. When the test is complete, read and record the following with units of measure:

Peak Load Tensile (Tensile Strength) (g/in)

Peak Elongation (Elongation) (%) (The average of MD Elongation and CD Elongation is reported as the Average Elongation)

Peak CD TEA (Wet CD TEA) (in-g/in$^2$)

Tangent Modulus (Dry MD Modulus and Dry CD Modulus) (at 15 g/cm)

Test each of the samples in the same manner, recording the above measured values from each test. Average the values for each property obtained from the samples tested to obtain the reported value for that property.

Basis Weight Test Method

Basis weight of a fibrous structure sample is measured by selecting twelve (12) individual fibrous structure samples and making two stacks of six individual samples each. If the individual samples are connected to one another vie perforation lines, the perforation lines must be aligned on the same side when stacking the individual samples. A precision cutter is used to cut each stack into exactly 3.5 in.×3.5 in. squares. The two stacks of cut squares are combined to make a basis weight pad of twelve squares thick. The basis weight pad is then weighed on a top loading balance with a minimum resolution of 0.01 g. The top loading balance must be protected from air drafts and other disturbances using a draft shield. Weights are recorded when the readings on the top loading balance become constant. The Basis Weight is calculated as follows:

$$\text{Basis Weight } (\text{lbs}/3000\ \text{ft}^2) = \frac{\text{Weight of basis weight pad (g)} \times 3000\ \text{ft}^2}{453.6\ \text{g/lbs} \times 12\ \text{samples} \times [12.25\ \text{in}^2\ \text{(Area of basis weight pad)}/144\ \text{in}^2]}$$

$$\text{Basis Weight } (\text{g/m}^2) = \frac{\text{Weight of basis weight pad (g)} \times 10{,}000\ \text{cm}^2/\text{m}^2}{79.0321\ \text{cm}^2\ \text{(Area of basis weight pad)} \times 12\ \text{samples}}$$

The filament basis weight of a fibrous structure is determined using the Basis Weight Test Method after separating all non-polypropylene materials from a fibrous structure (examples of methods for completing the separation are described below in the Weight Average Molecular Weight/Polydispersity Test Method).

Weight Average Molecular Weight/Polydispersity Test Method

The weight average molecular weight of the polypropylene present in the polypropylene fibrous elements, such as polypropylene filaments, a fibrous structure is determined by high temperature gel permeation chromatography (GPC). Any non-propylene material present in the fibrous structure must be separated from the polypropylene filaments. Different approaches may be used to achieve this separation. For example, the polypropylene filaments may be first removed by physically pulling the polypropylene filaments from the fibrous structure. In another example, the polypropylene filaments may be separated from the non-polypropylene material by dissolving the non-polypropylene material in an appropriate dissolution agent, such as sulfuric acid or Cadoxen.

In yet another approach, the step of separating the polypropylene filaments from non-polypropylene material may be combined with the dissolution of the polypropylene such that a portion of the fibrous structure with about 30 mg of polypropylene is placed in about 10-15 ml of 1,2,4-tricholorbenzene (TCB). This is heated to about 150° C. for about 3 hours with gentle shaking during the last 20 minutes of heating. This process dissolves the polypropylene. The hot TCB solution/suspension is then filtered through a heated 2-10 μm stainless steel frit (filter) to remove the undissolved material (non-polypropylene material).

The weight average molecular weight distribution and polydispersity (Mw and PD (PD=Mw/Mn)) are measured using GPC with refractive index (RI) detection based on polystyrene (PS) narrow standard retention times with k and a correction values applied (PS narrow standards: k=4.14, α=0.61; Polypropylene: k=1.56, α=0.76). The GPC uses 10 mm Mixed B (3) columns with TCB containing 0.5% BHT as mobile phase at 150° C. with a 1 ml/minute flow rate. Sample injection volume is 200 μl.

Diameter Test Method

The diameter of a polypropylene fibrous element, especially a polypropylene microfiber fibrous element, in a fibrous structure is determined by taking scanning electromicrographs of the fibrous structure and determining the diameter of the polypropylene fibrous element from its image.

Alternatively, the diameter of a polypropylene fibrous element, especially a polypropylene microfiber fibrous element, is determined by removing, if necessary, the polypropylene fibrous element to be tested from a fibrous structure containing such polypropylene fibrous element. The polypropylene fibrous element is placed under an optical microscope. The diameter of the polypropylene fibrous element is measured using a calibrated reticle and an objective of 100 power. Read the diameter of the polypropylene fibrous element in at least 3 positions (in the center of the visible polypropylene fibrous element and at 2 or more positions along the length of the polypropylene fibrous element near opposite boundaries of the viewing area). The average of the diameter measurements at the 3 or more positions is averaged and reported as the diameter of the polypropylene fibrous element.

Contact Angle Test Method

In order to prepare the samples (fibrous structures and/or fibrous elements) for contact angle measurement, the samples must be conditioned. The samples must be washed 3 times with distilled water. The samples are air dried at 73° F. Next, the samples are subjected to 120° F. at a relative humidity of 60% for 24 hours. The samples are then allowed to return to 73° F. The samples are tested in the conditioned room described above It is important to not permit the conditioned samples to be subjected to greater than 100° F. at a relative humidity of less than 60% prior to measuring the contact angle.

To conduct the contact angle test, 5-7 μL of Millipore purified water is deposited on to the sample. High speed video imaging at 120 frames per second is used to capture the contact and wetting of the drop on the sample. The contact angle measurement is taken on the second frame after detachment of the drop using First Ten Angstroms software available from First Ten Angstroms, Inc. of Portsmouth, Va.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for making a paper towel comprising a co-formed fibrous structure, the method comprising a step of commingling from about 30% to 90% by dry weight of the paper towel of a plurality of pulp fibers and from about 10% to about 70% by dry weight of the paper towel of a plurality of meltblown filaments derived from a polymer composition comprising 100% by weight of the polymer composition of one or more biodegradable, thermoplastic polymers selected from the group consisting of polylactic acid, polyhydroxyalkanoate, polycaprolactone, and mixtures thereof such that the paper towel exhibits a contact angle of less than 80°.

2. The method according to claim 1 wherein the paper towel exhibits a contact angle of less than 75°.

3. The method according to claim 1 wherein the paper towel further comprises a wetting agent, wherein the wetting agent comprises a surfactant.

4. The method according to claim 1 wherein the paper towel further comprises a wetting agent selected from the group consisting of: silicone surfactants, polyethylene glycols, glycols and mixtures thereof.

5. The method according to claim 1 wherein the paper towel further comprises a wetting agent, wherein the wetting agent is a melt additive wetting agent.

6. The method according to claim 1 wherein the one or more biodegradable, thermoplastic polymers comprises polylactic acid.

7. The method according to claim 1 wherein the plurality of pulp fibers comprises wood pulp fibers.

8. The method according to claim 1 wherein the step of commingling comprises commingling from about 40% to 80% by dry weight of the paper towel of a plurality of pulp fibers and from about 20% to about 60% by dry weight of the paper towel of a plurality of meltblown filaments.

9. The method according to claim 8 wherein the step of commingling comprises commingling from about 50% to 70% by dry weight of the paper towel of a plurality of pulp fibers and from about 30% to about 50% by dry weight of the paper towel of a plurality of meltblown filaments.

10. A method for making a paper towel comprising a co-formed fibrous structure, the method comprising a step of commingling a plurality of pulp fibers and a plurality of meltblown filaments derived from a polymer composition comprising 100% by weight of the polymer composition of one or more biodegradable, thermoplastic polymers selected from the group consisting of polylactic acid, polyhydroxyalkanoate, polycaprolactone, and mixtures thereof at a weight ratio of filaments to pulp fibers of from at least about 1:1 such that the paper towel exhibits a contact angle of less than 80°.

11. The method according to claim 10 wherein the step of commingling comprises commingling the plurality of meltblown filaments and the plurality of pulp fibers at a weight ratio of filaments to pulp fibers of from at least about 1:1.5 such that the paper towel exhibits a contact angle of less than 80°.

12. The method according to claim 11 wherein the step of commingling comprises commingling the plurality of meltblown filaments and the plurality of pulp fibers at a weight ratio of filaments to pulp fibers of from at least about 1:2 such that the paper towel exhibits a contact angle of less than 80°.

13. The method according to claim 10 wherein the paper towel exhibits a contact angle of less than 75°.

14. The method according to claim 10 wherein the paper towel further comprises a wetting agent, wherein the wetting agent comprises a surfactant.

15. The method according to claim 10 wherein the paper towel further comprises a wetting agent selected from the group consisting of: silicone surfactants, polyethylene glycols, glycols and mixtures thereof.

16. The method according to claim 10 wherein the paper towel further comprises a wetting agent, wherein the wetting agent is a melt additive wetting agent.

17. The method according to claim 10 wherein the one or more biodegradable, thermoplastic polymers comprises polylactic acid.

18. The method according to claim 10 wherein the plurality of pulp fibers comprises wood pulp fibers.

19. The method according to claim 10 wherein the step of commingling comprises commingling from about 30% to 90% by dry weight of the paper towel of a plurality of pulp fibers and from about 10% to about 70% by dry weight of the paper towel of a plurality of meltblown filaments.

20. The method according to claim 19 wherein the step of commingling comprises commingling from about 40% to 80% by dry weight of the paper towel of a plurality of pulp fibers and from about 20% to about 60% by dry weight of the paper towel of a plurality of meltblown filaments.

* * * * *